US005108092A

United States Patent [19]

Hurst

[11] Patent Number: 5,108,092

[45] Date of Patent: Apr. 28, 1992

[54] PORTABLE EXERCISE DEVICE

[76] Inventor: Bruce F. Hurst, 314 Gordon Street, Guelph, Ontario, Canada, N1G 1X6

[21] Appl. No.: 644,553

[22] Filed: Jan. 23, 1991

[30] Foreign Application Priority Data

Jan. 23, 1990 [CA] Canada ..... 2008358
Aug. 30, 1990 [GB] United Kingdom ..... 9018929.1

[51] Int. Cl.[5] ..... A63B 21/00

[52] U.S. Cl. ..... 482/60; 482/63; 482/908

[58] Field of Search ..... 272/73, 72, 144, 96, 272/93, DIG. 4, 100, 97; 128/25 R

[56] References Cited

U.S. PATENT DOCUMENTS

| | | | |
|---|---|---|---|
| D. 226,670 | 4/1973 | Nickels | D34/5 K |
| 3,100,640 | 8/1963 | Weitzel | 272/73 |
| 3,758,111 | 9/1973 | Agamian | 272/73 |
| 3,860,235 | 1/1975 | Del Mar | 272/73 |
| 4,262,902 | 4/1981 | Dranselka | 272/132 |
| 4,601,464 | 7/1986 | Mousel | 272/73 |
| 4,603,851 | 8/1986 | Russell | 272/96 |
| 4,749,190 | 7/1988 | Jennings | 272/144 |
| 4,856,775 | 8/1989 | Colledge et al. | 272/134 |
| 4,973,046 | 11/1990 | Maxwell | 272/73 |

FOREIGN PATENT DOCUMENTS

| | | |
|---|---|---|
| 767613 | 2/1957 | United Kingdom . |
| 1512241 | 5/1978 | United Kingdom . |
| 1552415 | 9/1979 | United Kingdom . |

*Primary Examiner*—Stephen R. Crow
*Attorney, Agent, or Firm*—R. Craig Armstrong

[57] ABSTRACT

The invention provides a portable exercise device having a leg pedal exercise producing member that does not have its own user seat and is operated by the user from an independent seat free of any mechanical connection between the exercise device and the independent seat. The device has a base, an arm pivotally connected thereto, and a pin passage through holes in brackets to support the arm at selected positions. A shaft is rotatably mounted across the arm near the end remote from the pivotally connected end thereof, and pedal shanks are secured to each end of the shaft on either side of the arm, each with a rotatable pedal mounted on the end thereof. The device is collapsible for transportation or storage. A flywheel mounted adjacent the arm may be provided. Preferably, the bottom surface of the base has at least a portion thereof of Sorbothane (trademark).

14 Claims, 4 Drawing Sheets

FIG. 4
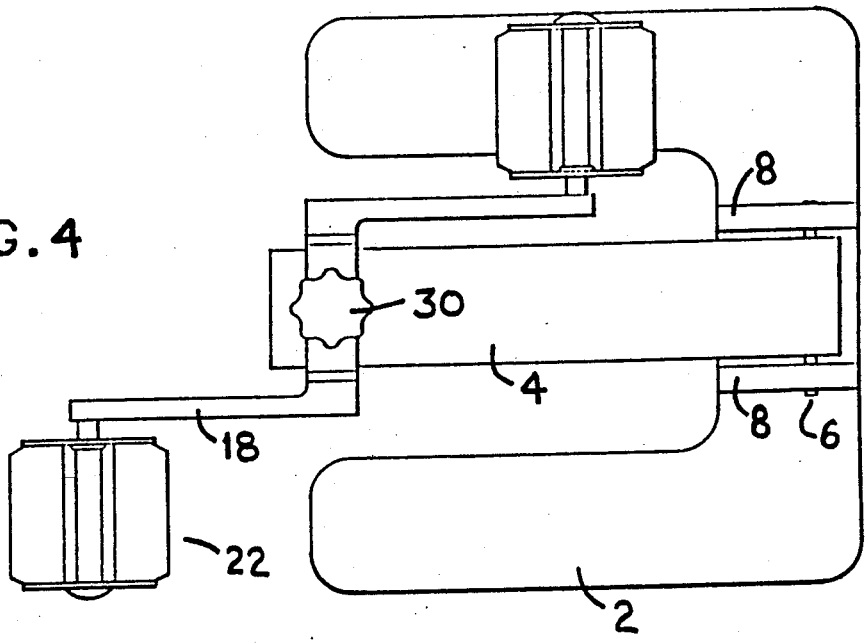
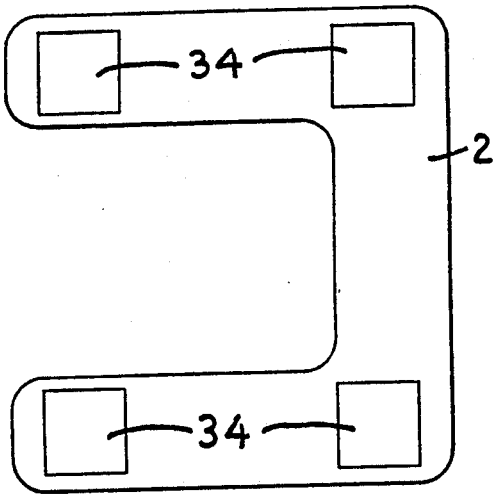
FIG. 5
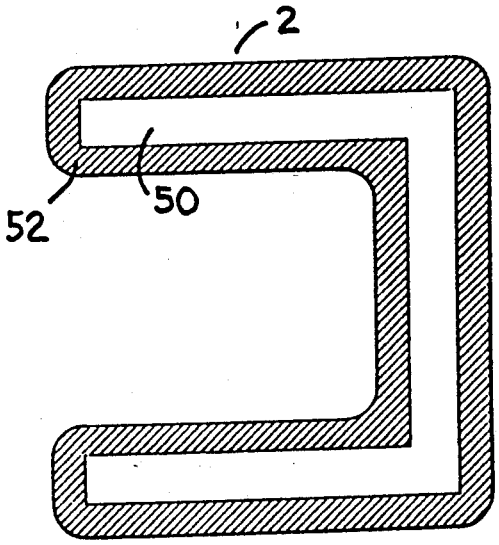
FIG. 6

PORTABLE EXERCISE DEVICE

BACKGROUND OF THE INVENTION

1. Field of the Invention

This invention relates to a portable pedal-operated exercise device which is free-standing and which does not include a user seat from which the device is operated. The device is operated from an independent seat not attached to the exercise device.

2. Description of the Prior Art

There are many different types of exercise devices. One very common device is the stationary bicycle. However, many people do not have the storage room for a conventional stationary bicycle, which is relatively bulky in its construction. Furthermore, many people such as invalids, the elderly, the handicapped and the like are not capable of physically mounting a conventional stationary exercise bike. The present inventor had observed that a conventional sit-on stationary bicycle in a nursing home was rarely used due to the effort required by the nursing home residents for mounting, seating, and balancing on the stationary bicycle, as well as the inconvenience of travelling to and from that stationary bicycle.

A number of different pedal-type exercise devices which do not include a user seat have been patented. A problem with all of those prior art devices known to the inventor is that each of them requires some type of mechanical connection between the device and the seat from which the device is operated. In most cases, this is a permanent connection or at least permanent to the extent that the connection is actually bolted or screwed directly to the seat. Such an arrangement is not practical for everyday use of an exercise device, particularly in locations such as nursing homes and hospitals where several people of different height and weight may wish to operate the device from a number of different supporting seats.

There also exist prior art structures which do not use a permanent connection, but rather which use a rearward extension of the device which locks onto the legs of the chair from which the device is operated. This is a better arrangement than a permanent connection, but still suffers from the drawback that it can be only used with a specific type of chair having front legs for receiving the connecting member. Furthermore, tilting of the chair rearwardly during operation of the exercise device may enable release of the mechanical connection from the chair legs.

Each and every one of the above structures requires some type of a connection simply because without this connection, each of the devices would slip across the floor or other supporting surface, making them awkward if not impossible to operate by the user.

Furthermore, none of the above structures is relatively light and foldable.

SUMMARY OF THE INVENTION

The present invention provides a portable exercise device which is extremely simple yet efficient in its operation. The portable exercise device of the present invention does not include its own user seat and further does not require any type of a mechanical connection between the device and the independent seat from which the device is operated. More particularly, the portable exercise device of the present invention includes a pedal exercise-producing member that does not have its own user seat and which is operated by the user from an independent seat free of any mechanical connection between the exercise device and the independent seat. The present invention further includes a base platform for the pedal exercise producing member with that base platform having a bottom surface provided with gripping means capable of gripping substantially any supporting surface on which the exercise device may be placed and resisting slippage along that supporting surface when the device is operated by the user.

In the preferred embodiment of the invention, the bottom surface gripping means is preferably in the form of some type of high co-efficient of friction synthetic polymer or rubber material, or a material having added adhesive qualities that allows use of the exercise device without any mechanical connection between the device and the user's chair.

Use of the present invention having such gripping means in combination with a seat of the user's choice obviates the need for pre-assembly of the device before each use to connect it to an independent chair, thereby enabling the invention to be used with considerably less effort than devices of the prior art.

A further advantage of the present invention is the convenient access to pedalling by hand, for which purpose the invention may be placed upon a table or other suitable support.

Another feature not seen in patented or marketed models is the provision of height adjustment and folding for storage or transporation. The height settings allow for various seating levels, ranging from low chairs to high hospital beds. This has been deemed important by more than one medical professional, as has the collapsed storage position, which is advantageous to hospitals and nursing homes because of their limited storage space.

BRIEF DESCRIPTION OF THE DRAWINGS

Further features of the invention will be described or will become apparent in the course of the following detailed description of the preferred embodiment, with reference to the accompanying drawings, in which:

FIG. 4 is a top view of the device in the collapsed position;

FIG. 5 is a bottom view of the device;

FIG. 6 is a cross-section of the base of the device;

DETAILED DESCRIPTION OF THE PREFERRED EMBODIMENT

Figure 1:
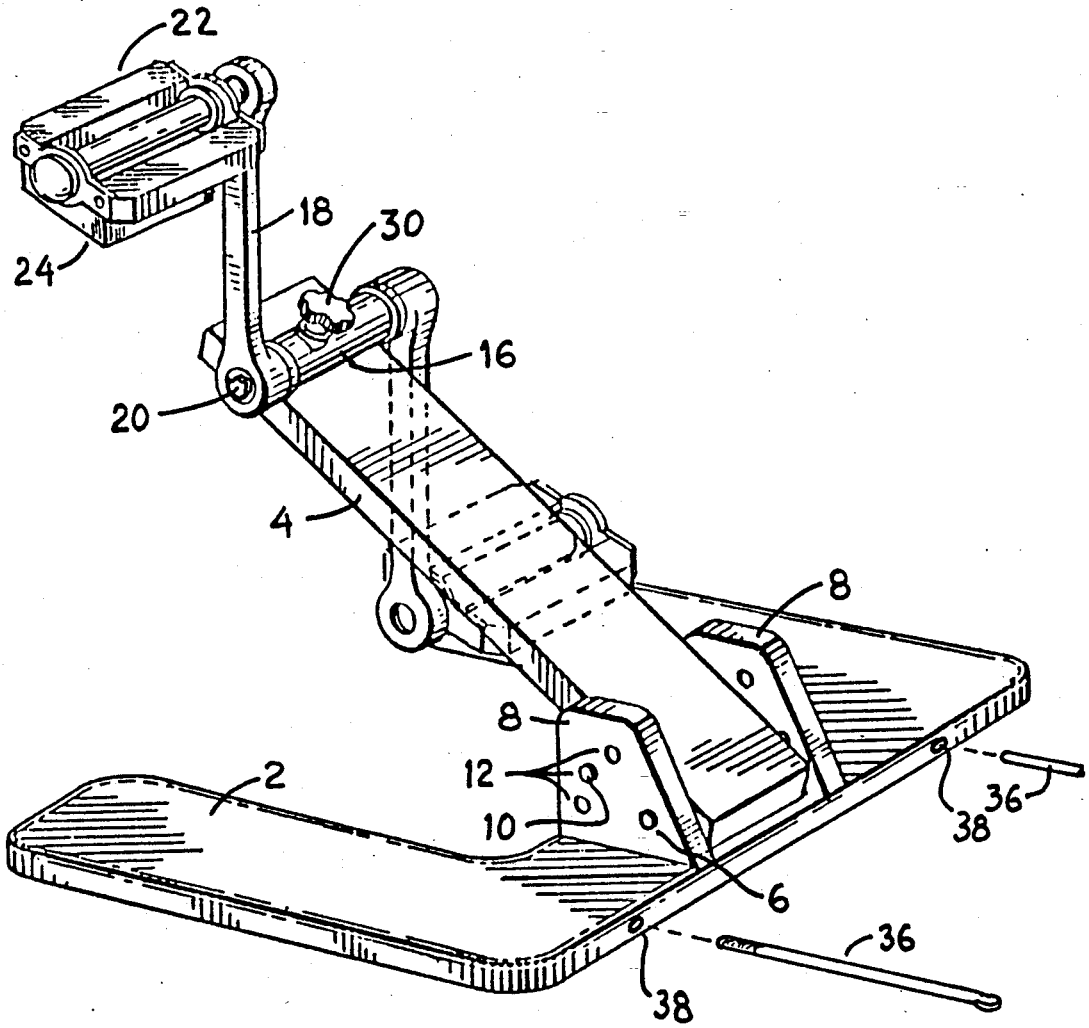
FIG. 1 is a perspective view looking down on a portable exercise device according to a preferred embodiment of the present invention.

The accompanying drawings show the preferred embodiment of the portable exercise device, by way of example only. The device includes a generally U-shaped base 2 and an arm 4 which is pivotally connected to the base by virtue of being mounted on a pin 6 which runs between support brackets 8 on either side of the arm.

A removable pin 10 is positionable between the support brackets in any one of several holes 12, to support the arm 4 at various heights as desired.

At or near the end of the arm remote from the pin 6 is mounted the pedal arrangement consisting of a shaft 14 passing through a tensioning mechanism 16. At each end of the shaft is a pedal crank 18, splined onto the end of the shaft and held in place there by a bolt 20. At the other end of the pedal orank is a oonventional rotatahle pedal 22, preferably carrying a weight 24 unless the embodiment incorporating a flywheel is used, as described later below.

Figure 7:
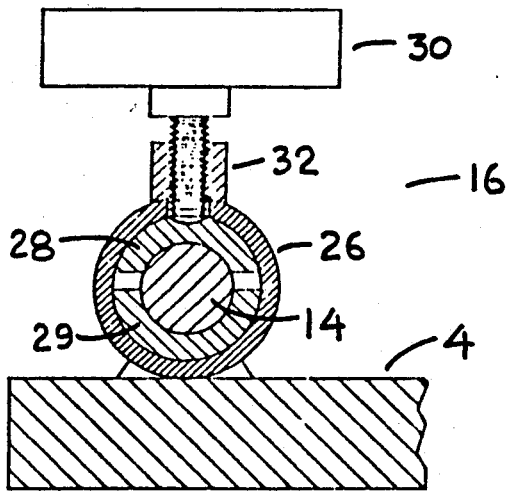
FIG. 7 is a cross-section of the tensioning mechanism.

As seen best in FIG. 7, the tensioning mechanism 16 involves an outer tube 26 and upper and lower bushing elements 28 and 29 respectively. A tensioning screw 30 threaded into a collar 32 can be tightened to force the upper bushing element, optionally via a similarly curved pressure plate, against the shaft 14, thus increasing friction as desired.

It will be readily appreciated by those knowledgeable in the field that many other suitable means of tensioning the pedals could be employed. This means is but one example of a suitable tensioning mechanism.

Figure 2:
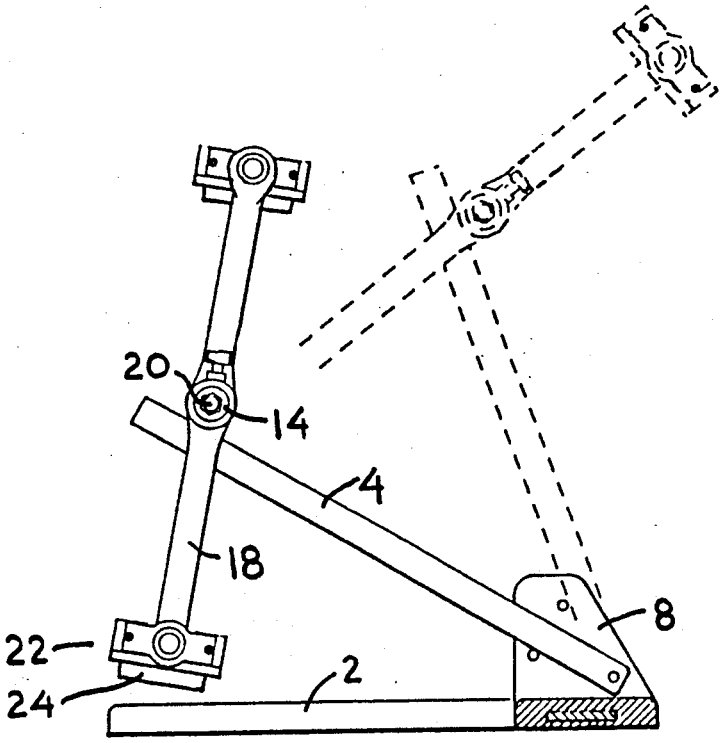
FIG. 2 is a side view of the device.
Figure 3:
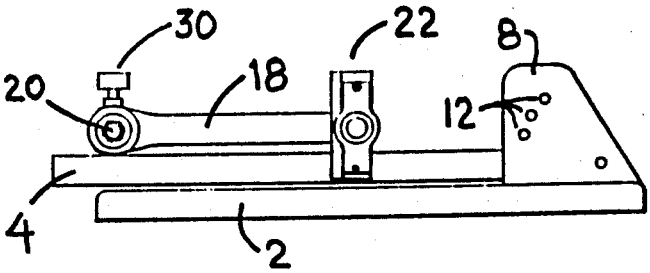
FIG. 3 is a side view showing the device in a collapsed or storage position.

As a result of this structure, the device is extremely portable in nature and is quickly and easily moved from the in-use positions shown in FIGS. 1 and 2 to the collapsed or storage position shown in FIGS. 3 and 4. The base 2 has a U-shaped configuration which allows flat folding of the arm 4 and which reduces weight and bulk of the device. The device does not include a user seat but rather is operated from an independent chair without any mechanical connection between the device and the chair. It is intended that the user should sit in an ordinary chair, for example, positioned with the two arms of the U-shape pointing towards the chair.

The device is quickly and easily folded to the collapsed storage position of FIGS. 3 and 4 by simply removing the pin 10 and pivoting the arm 4 down to the base 2. The pin can then be fitted into the lowermost hole to hold the arm in the collapsed position.

One of the key features of the exercise device is the provision of a grip material 34 on the bottom of base 2, covering all or part of the base, and preferably projecting slightly below the bottom. This grip material prevents slippage of the exercise device while operated by the user along the supporting surface on which the device is placed. An important feature of the invention is the use of a substance selected for preventing slippage of the base of the device along virtually any horizontal surface by not only gripping a surface merely to prevent slippage, the horizontal traction of which is referred to and not otherwise indicated by relevant patents, but by releasably adhering to that surface to reduce vertical movement. Certain rubbers and polymers may be lifted away from their adhesion to a surface; in the preferred embodiment the preferred substance is SORBOTHANE (trademark). The use of Sorbothane or any substance with similar non-staining adhesive qualities eliminates the need for a roughened, spiked, or ribbed bottom surface, so the bottom surface to be used in contact with the supporting surface will be smooth.

Although Sorbothane is the preferred substance, in alternate embodiments of the invention the pads of grip material 34 could be made of any suitable polymer or rubber having a very high co-efficient of friction and some adhesive characteristics.

For purposes of using the device on a carpeted surface, it should also be noted that the grip material can quickly and easily be washed to remove any carpet fibres or the like without taking away from the grip and/or adhesive qualities of the material. Owing to the adhesive quality of the substance used, fibres, particles, dust, and the like will be lifted, adhering to the substance, with the exercise device from the supporting surface, and the accumulation of those particles will correspond to the reduction in the adhesion of the grip substance. Those particles may be washed off with water or soap and water, as recommended by the manufacturer of Sorbothane. Experience with a prototype of invention has shown that even then the adhesion is reduced over time. The inventor has discovered that rubbing alcohol will easily and most effectively restore the original adhesiveness of the Sorbothane.

For added comfort and foot grip each of the pedals is also preferably provided with means for helping hold one's foot to the pedal. This can be in the form of a strap as found on a conventional bicycle or each of the pedals can be provided with the same grip material as is found on the bottom of the base.

In order to assist in the fully flat folding of the device, one of the bolts 20 can be loosened, allowing the user to rotate one pedal crank 18 to point in the same direction as the other pedal crank, producing the compact arrangement shown in FIG. 3.

For most applications, the use of the grip material 34 on the bottom of base 2 is sufficient to stabilize the device. However, it must be noted that with resistance pedalling of the exerciser with the pedestal arm locked at the high setting, even the adhesiveness of the Sorbothane or like material attached to the underside of the base may not prevent the exerciser from tipping forwards. To prevent tipping in such situations, optional anti-tip rods 36 may be used, extending forward from the base to provide greater stability. The rods may be rigid rods which thread into place in holes 38 in the front of the base, or they may be designed in telescopic fashion to be retractable into the base when not in use.

The base 2 is a steel framework 50 enclosed within an aesthetic and relatively pliable body of Integral Skin (trademark) foam 52. In the preferred embodiment, the foam is textured for an aesthetic leather-like appearance on units intended for the retail market. In an alternate embodiment, the foam for exercisers destined for hospitals and nursing homes has a smooth external skin to facilitate cleaning to maintain an aseptic and hygienic surface. Steel is in this case preferred due to its strength, reasonable cost, and its ease of welding in production assembly.

Figure 8:
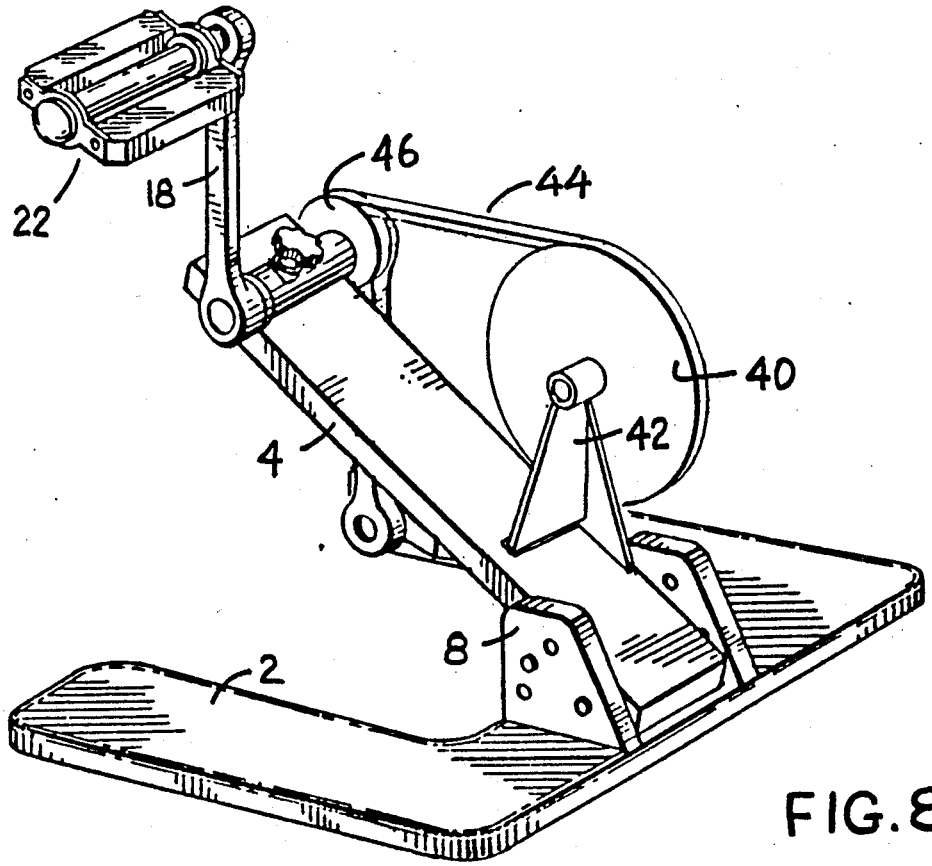
FIG. 8 is a perspective view of an alternative embodiment of the invention, including a flywheel.

A further feature addresses the momentum in pedalling. Steel flywheels, often exceeding ten pounds or 4.54 kilograms, are integral in the structure and operation of many stationary bicycles. As mentioned above, momentum in the case of the present invention may be applied with the assistance of a weight on the underside of each pedal, but as an alternative, as shown in FIG. 8, a flywheel arrangement may be used. The flywheel 40 is supported above the arm 4 by a support bracket 42, and is driven by a belt 44 which routes around a pulley 46 mounted on the shaft 14 inboard of one of the pedal cranks. The circumference of the flywheel to the circumference of the pulley should preferably be at least 2:1. The support bracket 42 may be easily mounted and removed from the arm 4, to facilitate transportation and storage, by virtue of being slidable into a groove in the top of the arm and being lockable therein, or by any other suitable readily detachable means.

In preparing to transport or store the device, the flywheel may be readily removed, and the device may then be folded flat for carrying ease and compact storage. The pin is pulled out from the middle or upper holes to release the arm, which is then lowered to rest in the flat position. A nut is removed from the left or right side crank, and the given crank is pulled out from the left or right side axle end, and the given crank is pulled out from the square end of the axle, turned 180 degrees, reconnected to the axle, and the nut is then replaced to fasten the crank securely to the axle. The pin 10 is inserted into the lowest position holes, and the tensioning screw 30 is tightened as much as is required to prevent the axle and cranks from turning and swinging away from the flat position. Alternatively, if such tightening is not found satisfactory, a fastener such as Velcro (trademark) may be used to secure the pedals to the upper surface of the base. The flywheel assembly may be laid on its side on top of or beside the horizontally lying exerciser, or beside it in the vertically standing position.

The description above relates to use of the device as a leg pedal exerciser. However, it can also be used for arm exercising where all of the same principles including the non-slip bottom apply. For comfort as an arm exerciser each of the pedals may be made of a softened qrip material as described above and/or may be fitted with a pedal cover comfortable to one's hand.

Various options could be readily added, such as a speedometer, an odometer, a heart monitor, etc.

A handle may be desired for carrying, and can be attached to the upper end of the arm, for example.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A portable exercise device comprising:

a base;

an arm pivotally connected near one end thereof to said base near one edge thereof, for pivotal movement angularly up and down with respect to said base;

means for supporting said arm at at least one position above said base where said arm is pivotally mounted to brackets on either side of said arm, and where said means for supporting said arm comprises a pin passable through holes in said brackets to engage the underside of said arm;

a shaft rotatably mounted on said arm in a transverse orientation across said arm remote from the pivotally connected end thereof;

pedal shanks secured to each end of said shaft on either side of said arm, each with a pedal rotatable about a horizontal axis mounted on the end thereof remote from said shaft; and tensioning means mounted on said device and selectively actuatable to restrict rotation of said shaft.

2. A portable exercise device as recited in claim 1, where said tensioning means comprises at least one bushing element positionable against said shaft, and screw means rotatable to force said bushing element against said shaft.

3. A portable exercise device as recited in claim 1, where said base is generally U-shaped, and where said arm is rotatable downwardly to a storage position where said arm is essentially between the arms of the U-shape.

4. A portable exercise device as recited in claim 1, further comprising a pulley mounted on said shaft between one said pedal shank and said arm, a flywheel rotatably mounted adjacent said arm in alignment with said pulley, and a belt routed around said pulley and said flywheel.

5. A portable exercise device as recited in claim 1, where the bottom surface of said base has at least a portion thereof out of an elastomeric material having adhesive surface characteristics.

6. A portable exercise device as recited in claim 1, where the bottom surface of said base has at least a portion thereof out of an elastomeric material having adhesive surface characteristics.

7. A portable exercise device as recited in claim 2, where the bottom surface of said base has at least a portion thereof out of an elastomeric material having adhesive surface characteristics.

8. A portable exercise device as recited in claim 3, where the bottom surface of said base has at least a portion thereof out of an elastomeric material having adhesive surface characteristics.

9. A portable exercise device as recited in claim 4, where the bottom surface of said base has at least a portion thereof out of an elastomeric material having adhesive surface characteristics.

10. A portable exercise device as recited in claim 1, where the bottom surface of said base has at least a portion thereof out of SORBOTHANE.

11. A portable exercise device as recited in claim 1, where the bottom surface of said base has at least a portion thereof out of SORBOTHANE.

12. A portable exercise device as recited in claim 2, where the bottom surface of said base has at least a portion thereof out of SORBOTHANE.

13. A portable exercise device as recited in claim 3, where the bottom surface of said base has at least a portion thereof out of SORBOTHANE.

14. A portable exercise device as recited in claim 4, where the bottom surface of said base has at least a portion thereof out of SORBOTHANE.

* * * * *